US005351418A

United States Patent [19]

du Plessis

[11] Patent Number: 5,351,418

[45] Date of Patent: Oct. 4, 1994

[54] PROCESS FOR DRYING OF GRANULAR OR POWDERED CARBON BY ELECTRICAL RESISTANCE HEATING

[76] Inventor: Cornelius J. du Plessis, 180 Dover Furnace Rd., Dover Plains, N.Y. 12522

[21] Appl. No.: 89,439

[22] Filed: Jul. 12, 1993

[51] Int. Cl.[5] ..... F26B 3/34

[52] U.S. Cl. ..... 34/246; 34/165; 110/225

[58] Field of Search ..... 34/1 A, 1 B, 165, 166, 34/167, 168, 169, 170, 171, 172, 173, 174, 175, 176, 177, 178; 110/224, 225

[56] References Cited

U.S. PATENT DOCUMENTS 2,744,477 5/1956 Hartley et al. ..... 110/225
4,038,052 7/1977 Melcher et al. ..... 34/1 A
4,481,890 11/1984 Lewis ..... 110/225

FOREIGN PATENT DOCUMENTS 47909 9/1979 Japan ..... 34/1 A

*Primary Examiner*—Denise Gromada

[57] ABSTRACT

A process of drying moist or wet carbon particles in a series of tubular drying sections by electrical resistance heating where the current is introduced into the uppermost column of carbon particles through a graphite block positioned at the center of the top of the said column by attachment to a steel plate that includes a flat or a V-shaped shelf and that is provided with openings to allow the moisture to escape in the form of steam and wherein the dried or partially dried carbon may be fed into a second or into a sequential plurality of similar sections provided with similar graphite blocks similarly positioned.

13 Claims, 1 Drawing Sheet

PROCESS FOR DRYING OF GRANULAR OR POWDERED CARBON BY ELECTRICAL RESISTANCE HEATING

CROSS-REFERENCE TO RELATED APPLICATION

This application is related to my copending application Ser. No. 08/089,444, filed Jul. 12, 1993.

BACKGROUND OF THE INVENTION

1. Field of the Invention

This invention relates to an apparatus and process for drying of carbonaceous feedstocks by electrical resistance heating. It particularly relates to an improved electrical resistance heating process in which the energy cost of drying is reduced, and the process is more efficient and faster and can accept carbonaceous feedstocks with higher moisture contents, larger ranges of particle size, and more variable particle size distributions as compared with previously described electrical resistance processes for the drying of carbon.

2. Description of the Related Art

The drying of wet powdered or granular solids requires the vaporization of the moisture followed by its physical removal, usually by a stream of air or other gas. The process is hastened by the application of heat either to the wet material or to the gas stream that is made to flow over or through the material. When the powdered or granular material is carbon, electrical resistance heating may be applied directly to the solids as is well known in the prior art relating to the activation of various carbonaceous feedstocks or to the reactivation of spent activated carbons, as described, for example, in U.S. Pat. No. 5,089,457 and prior patents cited therein. Effective rapid drying of wet carbons requires temperatures only about or modestly above the boiling point of water, such as temperatures in the range from 100° C. to about 150° C., whereas the activation of carbon feedstocks or the reactivation of spent activated carbons commonly requires temperatures of about 750° C. or higher.

When a moist or wet carbonaceous feedstock is activated or a wet spent activated carbon is reactivated by electrical resistance heating, the carbon is either dried prior to the activation or reactivation step, or else some or substantially all of the moisture is removed in the process of the activation or reactivation. In the latter case, as the vaporized moisture moves toward the furnace exit, through and past the section that preheats the carbon, it recondenses and offers increased resistance to the movement of other gases (such as CO and $H_2$) that are produced in the activation process or that are desorbed in the reactivation of spent activated carbons and that must escape to the exit. Still another disadvantage is the uneven current distribution that results from the variation in electrical resistance in different portions of the wet carbon.

It is accordingly an object of this invention to provide an improved process for the drying of wet granular or powdered carbon by electrical resistance heating.

It is another object of this invention to provide such improvement when the carbon contains any amount of moisture up to and including full saturation, so long as no free liquid water is present.

It is another object of this invention to provide such improvement when the carbon is a carbonaceous feedstock, such as wood char, coconut char, or petroleum coke, for the production of activated carbon, or is an exhausted activated carbon that is to be reactivated.

It is another object of this invention to provide that the electric current passing through the carbon being dried is distributed uniformly therethrough.

It is yet another object of this invention to insure that the moisture being removed from the carbon does not recondense on the carbon before it escapes.

The achievements of these and other objects will be apparent from the following description of the subject invention.

SUMMARY OF THE INVENTION

Briefly, the objects of this invention are achieved by improvements in a process that is conducted in an apparatus comprising a feed hopper from which the moist or wet carbon enters by gravity into a tubular drying section of refractory material or into a sequence of such sections, whose top is joined to the bottom of the feed hopper, and whose bottommost section may be joined to a reactor for activation of a carbonaceous feedstock or reactivation of a spent activated carbon or may feed into a container for the storage of the dried carbon, an electrical terminal affixed to the outside of the feed hopper and another terminal at the bottommost section, said terminals being connected to a source of electric current, the current passing between the terminals through the descending column of carbon particles. The improvements in the process include feeding the current into the uppermost column of carbon particles through a graphite block serving as an electrode and positioned at the center of the top of the said column and suspended above the top of the column by attachment to a steel plate that includes a flat or a V-shaped shelf and that is provided with openings to allow the moisture to escape in the form of steam. Additional improvements comprise feeding the partially dried carbon into a second or into a sequential plurality of similar sections provided with similar graphite blocks similarly positioned.

DESCRIPTION OF THE PREFERRED EMBODIMENTS

In the preferred embodiment, the carbon, if incompletely dried, is fed into one to three sequences of similar sections provided with similar graphite electrodes similarly positioned. If a sequential plurality of such columns is set up, and the number of such sections is in excess of that which is needed to dry the carbon satisfactorily, the path of the electric current may be selected so as to pass through only the lowermost one or more of said carbon columns as needed. The major advantages offered by the process of this invention include the provision for the prompt escape of the steam and other gases from the system in a single drying section or in a sequential plurality of drying sections, before such steam or other gases may recondense within a drying section and increase the system pressure or require further energy to revaporize, the greatly improved current distribution through the carbon provided by the graphite blocks, and the provision of flexibility by the opportunity to select the desired number of drying and steam-ejection stages consistent with the requirements of the carbon to be dried.

Figure 1:
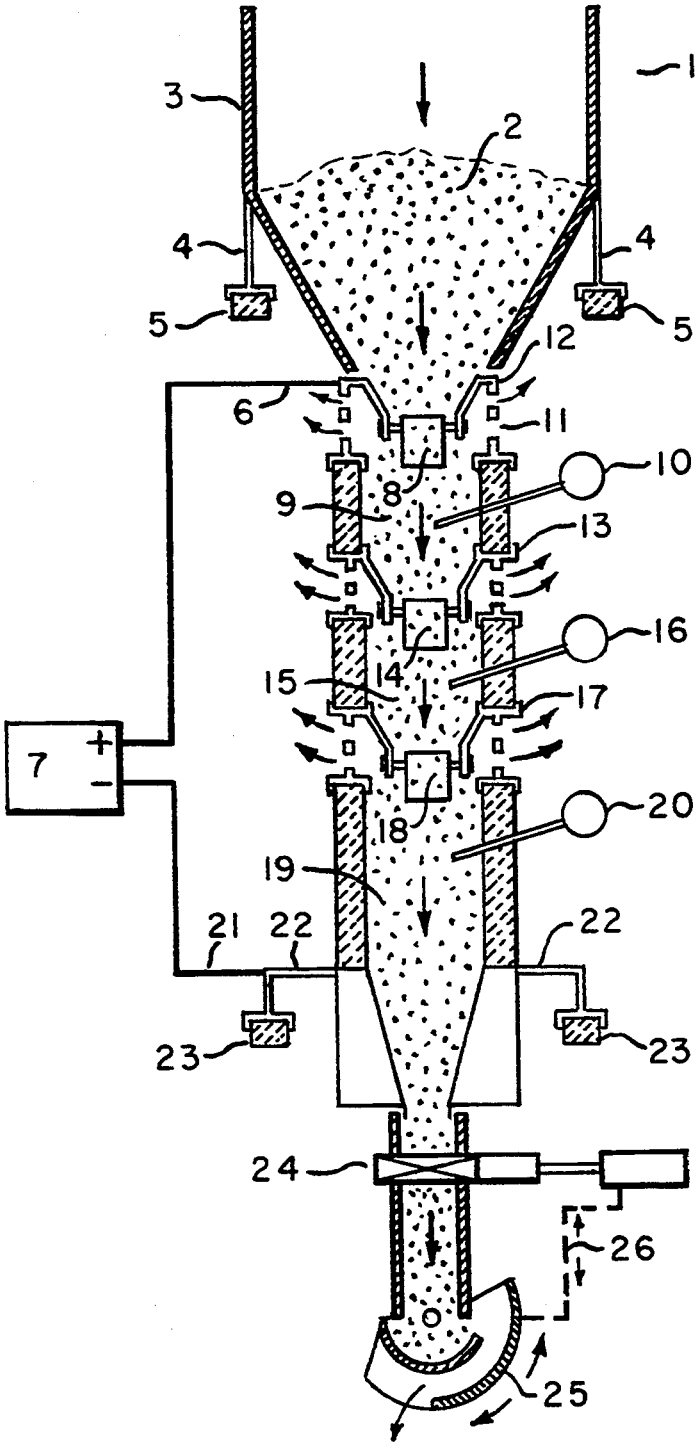
FIG. 1 shows an apparatus for use in the process of the drying of carbon by electrical resistance heating according to the present invention.
Figure 2:
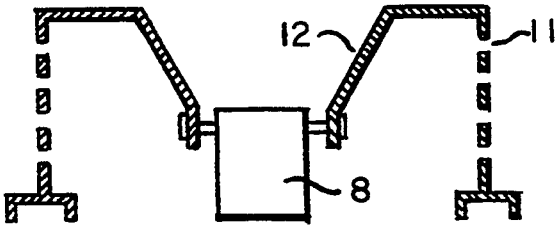
FIG. 2 shows a detail of the uppermost section of steel plate with its attached graphite electrode of FIG. 1.

The nature of my invention will be made clearer by referring to the accompanying drawings in FIGS. 1 and 2, which are partly diagrammatic and partly vertical sections of the apparatus 1. The wet carbon feedstock 2 is loaded into a metal feed hopper 3 of steel and the like, which is electrically isolated from its supports 4 by insulators 5. The feed hopper is attached to an electrical terminal 6, which is fed by a DC or AC power supply 7. The carbon moves by gravity around and past graphite block 8 into the first drying section 9. The shape of the graphite block is not critical. For example, it may be in the form of a portion of graphite rod or pipe of rectangular, circular, or other cross section. Its size, relative to the cross-sectional area of the space it occupies, should be large enough to provide sufficient surface area to distribute the current effectively to the carbon particles that flow past it, but not so large that it impedes the flow of said particles. For example, the cross sectional area of the graphite block projected to the horizontal plane may range from about ¼ or less of cross sectional area of the opening in which it is placed to about ¾ or even more of such area, if the carbon granules can flow effectively around it. The temperature of the carbon is measured by thermocouple 10. The steam and other vapors emitted from the wet carbon feedstock in the first drying section 9 escape through slots 11 in a first plate 12. Details of first plate 12 are shown in FIG. 2 which presents an enlarged view of first plate 12, showing the location of graphite block 8 in relationship to first plate 12, slots 11 through which steam and other vapors escape from first drying section 9, and the V-shaped design of the shelf of first plate 12 that provides support for the column of carbon particles in feed hopper 3 above first plate 12. The design of first plate 12 and graphite block 8 and their relative positions in relation to each other permit the carbon particles to pass past block 8 through first plate 12 into the second drying section 15.

The partially dried carbon continues to flow by gravity through the opening of second plate 13 around and past the second graphite block 14 into a second drying section 15, which is also provided with a thermocouple 16. A similar arrangement of a third plate 17 and a third graphite block 18 leads to a third drying section 19, which is likewise provided with a thermocouple 20. In the event that two drying sections are sufficient to dry the carbon to the degree necessary, the terminal 6 can be moved down so that the current enters via plate 13, leaving the first drying section 9 without current so that it serves merely as a continuation or extension of the feed hopper. Similarly, if only one drying section is sufficient, terminal 6 can be moved down to the third plate 17. Alternatively, the apparatus can be constructed with only one or two drying sections. On the other hand, if more than three drying sections are needed, the apparatus can be constructed to include any required number of such sections, as is evident from the description of this invention. Those skilled in the art will understand that the design details of the second plate 13 and the third plate 17 can conform to those of first plate 12 as described above and depicted in FIG. 2.

The bottom of the apparatus is connected to the other terminal 21 of the DC or AC power supply. It is electrically isolated from its supports 22 by insulators 23. The discharge of the apparatus can be held in a receiving storage container, such as a steel drum, or it can be fed directly into an apparatus for the activation of the dried carbon feedstock or for the reactivation of dried spent carbon. One discharge means is depicted in FIG. 1 and is useful when the dried carbon particles are to be held in a receiving storage container. In this embodiment, the dried carbon particles are discharged through knife gate valve 24, which is preferably pneumatically operated by a suitable timer so that it opens for brief periods at set intervals. The discharged carbon enters metering device 25, which limits the amount of material accepted when knife gate valve 24 opens. Metering device 25 is linked to knife gate valve 24 by mechanical linkage 26 or other suitable device so that it operates each time the valve opens and at no other time. The carbon passing through metering device 25 may be collected in suitable storage containers, such as steel drums and the like, not shown in FIG. 1.

My invention will be made clearer by the following examples which are presented for illustration only, and are not considered as limiting the subject invention as claimed herein.

EXAMPLE 1

A charge of exhausted activated carbon from coconut shell containing 20% moisture by weight was introduced into the feed hopper 3. The temperatures in the three drying sections 9, 15, and 19 shown in the drawing were kept at 300° to 500° C. As the carbon progressed through the apparatus, it was found that the moisture content of the received product was less than 0.1% by weight. The carbon throughput was continued while the terminal 6 was moved down so that the current passed only through drying sections 15 and 17. It was now found that the moisture content of the received product was about 1.8% by weight. The terminal 6 was again moved down, while the carbon throughput continued, so that the current passed only through drying section 17. It was then found that the moisture content of the received product was greater than 5% by weight. Accordingly, the terminal had to be returned to the upper contact so the current passed through all the drying sections if a very dry product was required. If a moisture content up to a limit of 2% would be acceptable, the terminal could be placed in the intermediate position so that the current passed only through drying sections 15 and 19.

EXAMPLE 2

A charge of pelletized petroleum coke containing 2% moisture by weight was introduced into the feed hopper 3. The temperatures in the three drying sections 9, 15, and 19 shown in FIG. 1 were kept at 250° to 300° C. As the carbon progressed through the apparatus, it was found that the moisture content of the received product was less than 0.1% by weight. The carbon throughput was continued while the terminal 6 was moved down so that the current passed only through drying sections 15 and 19. It was now found that the moisture content of the received product was still less than 0.1% by weight. Accordingly, the terminal 6 was again moved down, while the carbon throughput continued, so that now the current passed only through drying section 17. It was again found that the moisture content of the received product was less than 0.1% by weight. Accordingly, drying attained by passing the current only through section 19 was sufficient to realize effective drying of the carbon.

The practice of this invention using the process and apparatus described above has an additional advantage in that besides removing moisture from the carbon feedstocks, the process also serves to remove volatile oils and solvents present in the feedstocks.

I claim:

1. In a process for the drying of carbon by electrical resistance heating that comprises passing the wet carbon by gravity through a feed hopper into tubular drying sections of refractory material, wherein the top of the uppermost drying section is joined to the bottom of the feed hopper, and wherein the bottom of the lowermost drying section is joined to a reactor for activation of a carbonaceous feedstock, an electrical terminal affixed to the outside of the feed hopper and another terminal affixed at the bottommost section, said terminals being connected to a source of electric current, the current passing between the terminals through the descending column of carbon particles, the improvement wherein the current is fed into the uppermost column of carbon particles through a graphite block serving as an electrode and positioned at the center of the top of the column by attachment to a steel plate that includes a shelf and that is provided with openings to allow the moisture to escape in the form of steam.

2. A process according to claim 1 wherein the number of drying sections is 3.

3. A process according to claim 1 wherein, if the number of such sections is in excess of that which is needed to effectively dry the carbon, the path of the electric current is selected so as to pass through only the lowermost of said sections.

4. A process according to claim 1 wherein the discharge from the apparatus can be held in a receiving storage container.

5. A process according to claim 1 wherein the dried carbon is fed into a second section provided with a similar graphite block similarly positioned.

6. A process according to claim 1 wherein the discharge of the carbon can be fed directly into an apparatus for the reactivation of dried spent carbon.

7. A process according to claim 1 wherein the shelf is flat.

8. A process according to claim 1 wherein the shelf is V-shaped.

9. A process according to claim 1 wherein the number of drying sections is 4.

10. A process according to claim 1 wherein the electric current is selected to pass through the lowermost one of said sections.

11. A process according to claim 1 wherein the carbon feedstock is spent activated carbon.

12. A process according to claim 5 wherein the carbon is partially dried.

13. A process according to claim 1 wherein the discharge of the carbon is fed into a container for the storage of the dried carbon.

* * * * *